US007800515B2

(12) United States Patent
Chen

(10) Patent No.: US 7,800,515 B2
(45) Date of Patent: Sep. 21, 2010

(54) WARNING SYSTEM FOR BARRIERS OF HIGHWAYS

(75) Inventor: Chih-Hung Chen, 3F., No.490-3, Sinfong St., Jhongjheng District, Keelung (TW)

(73) Assignees: Chih-Hung Chen, Keelung (TW); Kuo-Liang Su, Taipei (TW)

( * ) Notice: Subject to any disclaimer, the term of this patent is extended or adjusted under 35 U.S.C. 154(b) by 479 days.

(21) Appl. No.: 11/957,583

(22) Filed: Dec. 17, 2007

(65) Prior Publication Data

US 2009/0153361 A1 Jun. 18, 2009

(51) Int. Cl.
*G08G 1/095* (2006.01)
*G08B 5/22* (2006.01)

(52) U.S. Cl. ..... 340/907; 340/908; 340/908.1; 340/815.45; 362/559; 362/800; 256/13.1; 404/6; 116/63 R; 40/612

(58) Field of Classification Search ..... 340/907, 340/908, 908.1
See application file for complete search history.

(56) References Cited

U.S. PATENT DOCUMENTS 5,760,686 A * 6/1998 Toman ..... 340/540
5,950,992 A * 9/1999 Weid ..... 256/13.1
6,366,214 B1 * 4/2002 Mitchell et al. ..... 340/815.45
6,644,888 B2 * 11/2003 Ochoa ..... 404/6
6,812,855 B1 * 11/2004 Sudou et al. ..... 340/907
6,822,578 B2 * 11/2004 Pederson ..... 340/815.45
7,018,129 B1 * 3/2006 Smith ..... 404/6

* cited by examiner

*Primary Examiner*—Donnie L Crosland
(74) *Attorney, Agent, or Firm*—Alan Kamrath; Kamrath & Associates PA

(57) ABSTRACT

A warning system for barriers of highways comprises a plurality of barrier plates erected on two sides of roads in a different distance arrangement, and each including an optical fiber and a power line for network connection and communication connected therewith, and including a plurality of LED warning lights and LED illumination lights attached thereon; a number of electric control boxes affixed onto the barrier plates in a different distance arrangement, and each electrically connecting with the optical fiber and the power line for controllably changing warning and illuminating signs of the LED warning lights and the LED illumination lights; a plurality of solar energy devices matching with the electrical control boxes for absorbing and storing solar energy to supply power in the night or in electricity shortage; multiple monitor stations severing to monitor the electrical control boxes for controlling the LED warning lights of the barrier plates to change warning signs.

10 Claims, 4 Drawing Sheets

WARNING SYSTEM FOR BARRIERS OF HIGHWAYS

BACKGROUND OF THE INVENTION

1. Field of the Invention

The present invention relates to a warning system, and more particularly to a warning system for barriers of highways that while a barrier plate is broken in a car accident, the LED warning lights within the broken zone will emit specific lights to warn drivers.

2. Description of the Prior Arts

Conventional barrier for highways is generally made of metal in a punching manner and may cooperate with cement columns to form elongated continuous protection structures. However, since the government is short of sufficient budget, the conventional optronics facilities on highways, e.g., power supply, power line, can not be constructed completely, resulting in deficient illumination and communication equipments. What is worse if some emergency situations happen in a remote place where the communication equipment, such as cell phone, will not operate well, maydays will be accordingly delayed. Moreover, if the conventional barrier for use in highways is broken, it can not make a warning light or sign to call drivers' attention, causing a driving danger.

The present invention has arisen to mitigate and/or obviate the afore-described disadvantages.

SUMMARY OF THE INVENTION

The primary object of the present invention is to provide a warning system for barriers of highways that while a barrier plate is broken in a car accident, the LED warning lights within the broken zone will emit specific lights to warn drivers.

Another object of the present invention is to provide a warning system for barriers of highways that when emergency situation happens in a remote area where the communication equipment such as cell phone, will not operate well, the LED warning light will make warning signs and then transmit mayday massages to the monitor station.

In accordance with one aspect of the present invention, there is provided a warning system for barriers of highways comprising a number of barrier plates erected on two sides of roads in a different distance arrangement, and each including an optical fiber and a power line for network connection and communication connected therewith, and including a plurality of LED warning lights and LED illumination lights attached thereon (the LED warning lights are arranged on the basis of a 4 M distance, yet the LED illumination lights are arranged on the basis of a 48 M distance);

a plurality of electric control boxes affixed onto the barrier plates in a different distance (e.g., 1 KM distance) arrangement, and each electrically connecting with the optical fiber and the power line for controllably changing warning and illuminating signs of the LED warning lights and the LED illumination lights;

a plurality of solar energy devices matching with the electrical control boxes for absorbing and storing solar energy to supply power in the night or in electricity shortage;

multiple monitor stations serving to monitor the electrical control boxes for controlling the LED warning lights of the barrier plates to change warning signs.

The barrier plate further includes multiple network access points provided therein and spaced apart from each other on the basis of a specific distance (such as an 8 M distance), thereby obtaining a guiding and illuminating purpose to prevent accident.

The present invention will become more obvious from the following description when taken in connection with the accompanying drawings, which show, for purpose of illustrations only, the preferred embodiment in accordance with the present invention.

DETAILED DESCRIPTION OF THE PREFERRED EMBODIMENT

Figure 1:
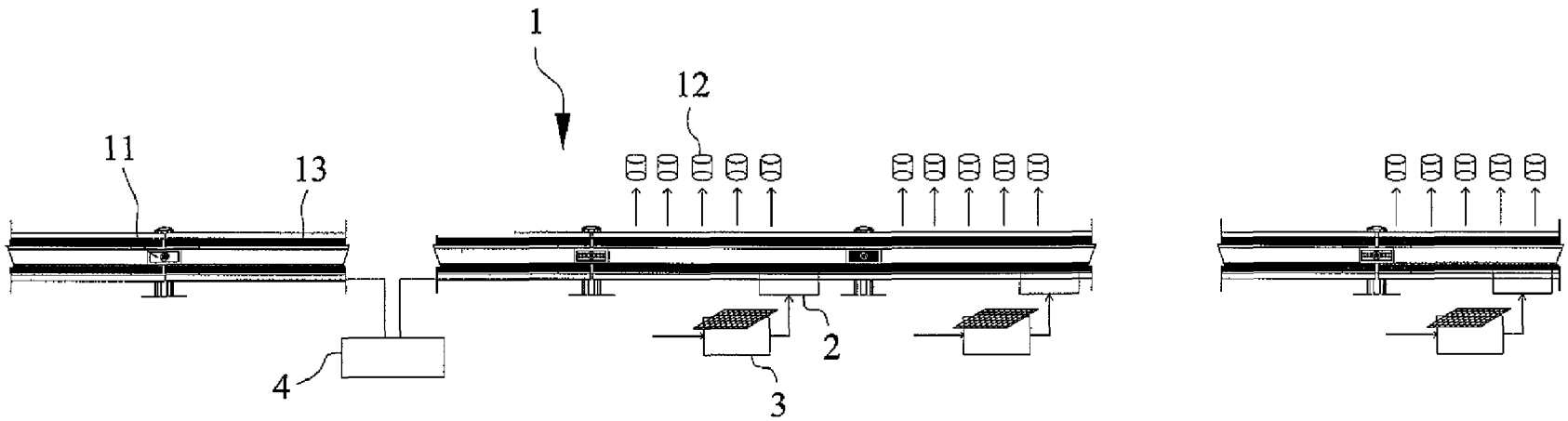
FIG. 1 is a perspective diagram illustrating the exploded components of a warning system for barriers of highways according to the present invention.

Referring to FIG. 1, a warning system for barriers of highways in accordance with the present invention comprises a number of barrier plates 1 erected on two sides of roads in a different distance arrangement, and each including an optical fiber and a power line for network connection and communication connected therewith, and including a plurality of LED warning lights 11 and LED illumination lights 12 attached thereon;

a plurality of electric control boxes 2 affixed onto the barrier plates 1 in a different distance arrangement, and each electrically connecting with the optical fiber and the power line for controllably changing warning and illuminating signs of the LED warning lights 11 and the LED illumination lights 12;

a plurality of solar energy devices 3 matching with the electrical control boxes 3 for absorbing and storing solar energy to supply power in the night or in electricity shortage;

multiple monitor stations 4 severing to monitor the electrical control boxes 2 for controlling the LED warning lights 11 of the barrier plates 1 to change warning signs.

Figure 2:
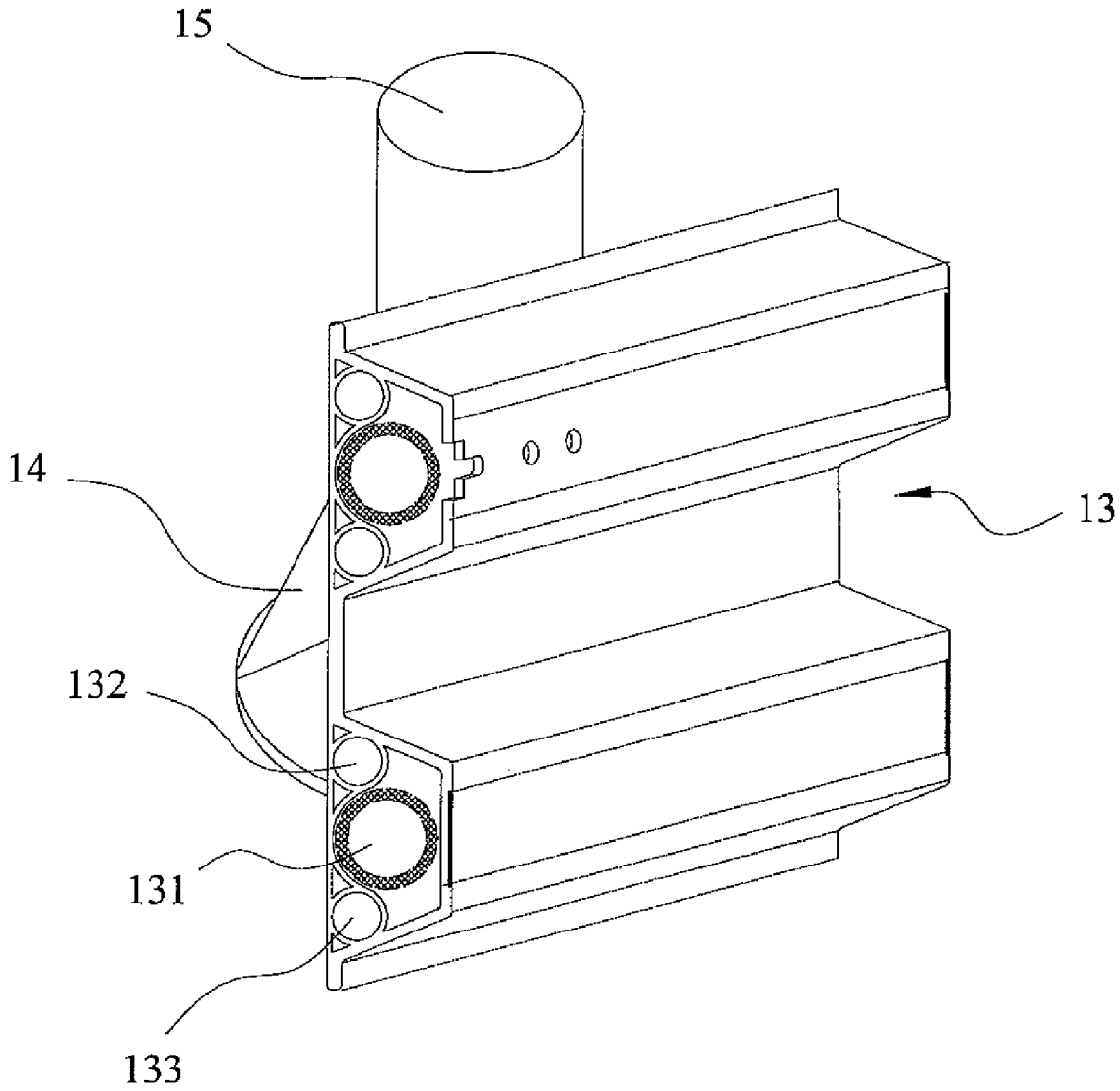
FIG. 2 is a perspective diagram illustrating the assembly of a barrier plate of the warning system for barriers of highways according to the present invention.
Figure 3:
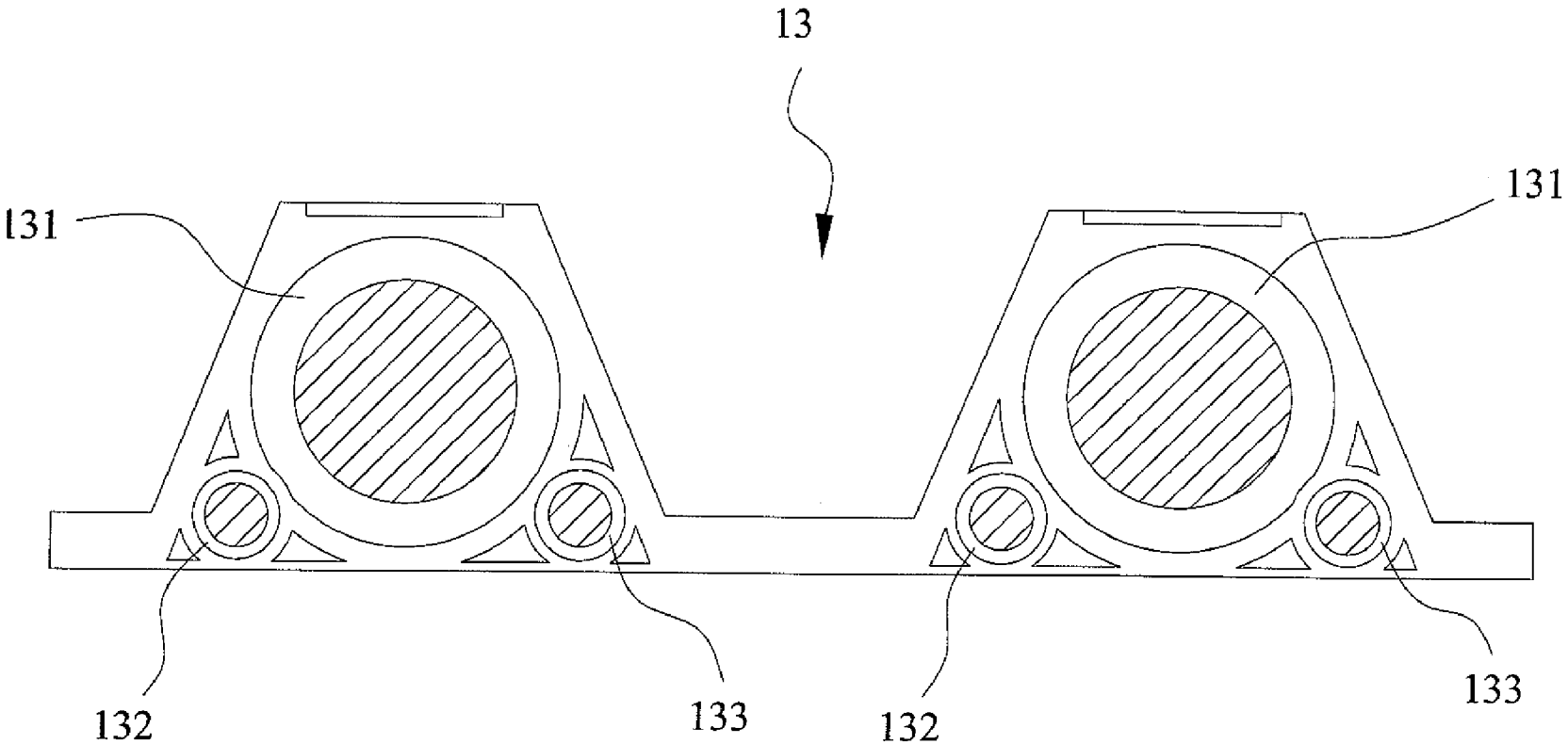
FIG. 3 is a cross sectional diagram illustrating the assembly of the barrier plate of the warning system for barriers of highways according to the present invention.

As shown in FIGS. 2 and 3, the barrier plate 1 is comprised of a M-shaped protective member 13, a saddle 14 and a support 15, wherein the M-shaped protective member 13 is made of plastic material and integrally press formed, and includes continuous and spaced raised surfaces and concaved planes formed on the outer sidewall thereof, and includes spaced first, second, and third passages 131, 132, 133 formed in the inner rim thereof for receiving an optical fiber of communication and network connection, a power line, and a high tensile cord individually; the saddle 14 is made of plastic material and includes retaining portion for cooperating with the M-shaped protective member 13 and the adhesive portion for matching with the support 15; the support 15, one end of which is inserted in the ground, is retained by using two clamping seats and then positioned by passing bolts through the saddle 14.

Figure 4:
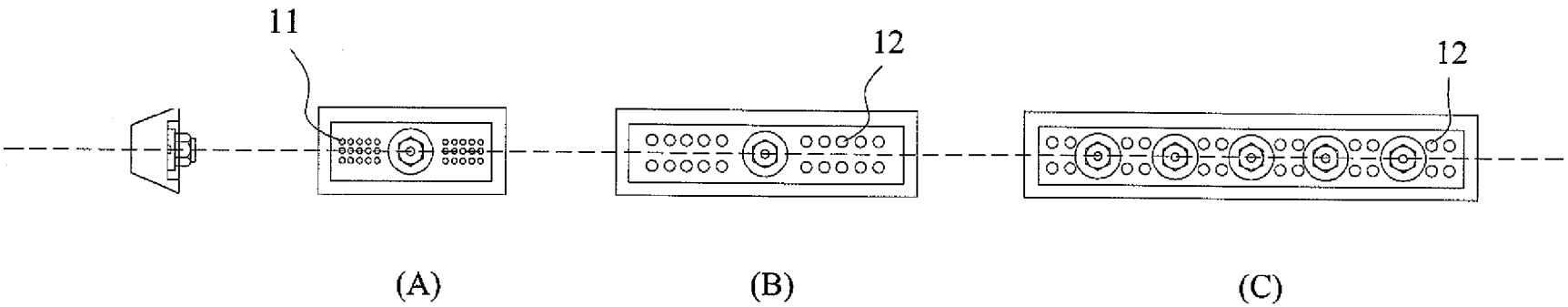
FIG. 4 is a plan diagram illustrating the assembly of LED warning and illumination lights of the warning system for barriers of highways according to the present invention.

As illustrated in FIG. 4, number A donates an embodiment of the LED warning light 11 including a plurality of LEDs arranged tightly; numbers B and C imply the implements of the LED illumination lights 12, wherein number B shows the LED illumination light 12 includes a number of LEDs arranged in a highly concentrated manner, yet number C illustrates the LED illumination light 12 includes multiple LEDs arranged in a loose manner.

The implements and functions of the present invention would be explained as follows:

The plurality of barrier plates 1 are erected on two sides of highways, and then multiple monitor stations 4 which are spaced apart from each other on the basis of a 40 KM distance are set, and between two monitor stations 4 are disposed an electrical control box 2 and a solar energy device 3 on the basis of a 1 KM distance, yet the barrier plate 1 within the control range of the electrical control box 2 includes a plurality of LED warning lights 11 attached thereon and spaced apart from each other on the basis of a 4 M distance, and also includes a number of LED illumination lights 12 attached thereon and spaced apart from each other on the basis of a 48 M distance. The barrier plate 1 further includes multiple network access points 20 provided therein and spaced apart from each other on the basis of an 8 M distance, thereby obtaining a guiding and illuminating purpose to prevent accident.

While the barrier plate 1 is broken in a car accident, the breakdown massage will be transmitted to the monitor station 4 through the electrical control box 2, hence the broken position thereof will be displayed and the LED warning lights within 1 KM of the broken barrier plate 1 will emit specific lights to warn drivers.

When emergency situation happens in a remote area where the communication equipment, such as cell phone, can not be operated well, the network access point 20 arranged on the basis of a 8 M distance may be used to call for help, such that the LED warning light 11 makes warning signs and then transmits mayday massage to the monitor station 4.

On the other hand, while the barrier plate 1 is erected on two sides of the specific highway or mountain roads, the M-shaped protective member 13 may be provided to stop car downfall, and in the first passage 131 of the joining portion of the support 15 is fitted a tubular member in which a high tensile cord is inserted, enhancing protection.

It can be clearly seen from the preceding accounts on the features of the present invention that the warning system for barriers of highways of the present invention has the following advantages:

1. While the barrier plate is broken in a car accident, the LED warning lights within the broken zone will emit specific lights to warn drivers.

2. When emergency situation happens in a remote area where the communication equipment, such as cell phone, can not be operated well, the LED warning light makes warning signs and then transmits mayday massages to the monitor station.

3. The M-shaped protective member may be provided to receive the optical fiber and the power line, lowering wiring cost.

4. The solar energy device may be utilized to auxiliarily supply power, saving energy sources.

5. The warning system for barriers of highways may be constructed and maintained quickly, decreasing construction and maintenance costs.

The invention is not limited to the above embodiment but various modifications thereof may be made. It will be understood by those skilled in the art that various changes in form and detail may be made without departing from the scope and spirit of the present invention.

What is claimed is:

1. A warning system for barriers of highways comprising:

a number of barrier plates erected on two sides of roads in a different distance arrangement, and each including an optical fiber and a power line for network connection and communication connected therewith, and including a plurality of LED warning lights and LED illumination lights attached thereon;

a plurality of electric control boxes affixed onto the barrier plates in a different distance arrangement, and each electrically connecting with the optical fiber and the power line for controllably changing warning and illuminating signs of said LED warning lights and said LED illumination lights;

a plurality of solar energy devices matching with said electrical control boxes for absorbing and storing solar energy to supply power in the night or in electricity shortage;

multiple monitor stations serving to monitor said electrical control boxes for controlling said LED warning lights of said barrier plates to change warning signs.

2. The warning system for barriers of highways as claimed in claim 1, wherein it is preferable that said LED illumination lights are spaced apart from each other on the basis of a 4 M distance.

3. The warning system for barriers of highways as claimed in claim 1, wherein it is preferable that said LED warning lights are spaced apart from each other on the basis of a 48 M distance.

4. The warning system for barriers of highways as claimed in claim 1, wherein it is preferable that said electric control boxes are spaced apart from each other on the basis of a 1 KM distance.

5. The warning system for barriers of highways as claimed in claim 1, wherein it is preferable that said monitor stations are spaced apart from each other on the basis of a 40 KM distance.

6. The warning system for barriers of highways as claimed in claim 1, wherein each of said LED warning light includes a plurality of LEDs arranged tightly.

7. The warning system for barriers of highways as claimed in claim 1, wherein each of said LED illumination lights includes a number of LEDs arranged in a highly concentrated manner.

8. The warning system for barriers of highways as claimed in claim 1, wherein each of said LED illumination lights includes multiple LEDs arranged in a loose manner.

9. The warning system for barriers of highways as claimed in claim 1, wherein each of said barrier plate further includes multiple network access points provided therein.

10. The warning system for barriers of highways as claimed in claim 9, wherein said network access points are spaced apart from each other on the basis of an 8 M distance.

* * * * *